US008158872B2

(12) United States Patent
Parash

(10) Patent No.: US 8,158,872 B2
(45) Date of Patent: Apr. 17, 2012

(54) PORTABLE MULTIMEDIA OR ENTERTAINMENT STORAGE AND PLAYBACK DEVICE WHICH STORES AND PLAYS BACK CONTENT WITH CONTENT-SPECIFIC USER PREFERENCES

(75) Inventor: Avi Parash, Zikhron Yaakov (IL)

(73) Assignee: CSR Technology Inc., San Jose, CA (US)

( * ) Notice: Subject to any disclaimer, the term of this patent is extended or adjusted under 35 U.S.C. 154(b) by 936 days.

(21) Appl. No.: 11/963,629

(22) Filed: Dec. 21, 2007

(65) Prior Publication Data

US 2009/0183622 A1 Jul. 23, 2009

(51) Int. Cl.
*G10H 1/36* (2006.01)
*G10H 7/00* (2006.01)

(52) U.S. Cl. ..... 84/610; 434/307 A

(58) Field of Classification Search ..... 434/307 A
See application file for complete search history.

(56) References Cited

U.S. PATENT DOCUMENTS 5,499,922 A * 3/1996 Umeda et al. ..... 434/307 A
5,641,927 A * 6/1997 Pawate et al. ..... 84/609
5,648,628 A * 7/1997 Ng et al. ..... 84/610
5,654,516 A * 8/1997 Tashiro et al. ..... 84/601
5,824,934 A * 10/1998 Tsurumi et al. ..... 84/609
5,941,711 A * 8/1999 Iida et al. ..... 434/307 A
5,953,005 A * 9/1999 Liu ..... 715/243
5,980,261 A * 11/1999 Mino et al. ..... 434/307 A
6,025,553 A * 2/2000 Lee ..... 84/610
6,083,009 A * 7/2000 Kim et al. ..... 434/307 A
6,118,064 A * 9/2000 Yamamoto ..... 84/477 R
6,148,086 A * 11/2000 Ciullo et al. ..... 381/106
6,206,704 B1 * 3/2001 Tsai ..... 434/307 A
6,278,048 B1 * 8/2001 Lee ..... 84/610
6,328,570 B1 * 12/2001 Ng ..... 434/307 A
6,702,584 B2 * 3/2004 Ueshima et al. ..... 434/307 A
6,911,592 B1 6/2005 Futamase et al.
6,931,377 B1 * 8/2005 Seya ..... 704/277
6,967,275 B2 * 11/2005 Ozick ..... 84/616
7,169,996 B2 1/2007 George et al.
7,171,174 B2 1/2007 Ellis et al.
7,408,106 B2 * 8/2008 Weiner et al. ..... 84/610
2003/0019347 A1 * 1/2003 Weiner et al. ..... 84/609
2003/0100965 A1 5/2003 Sitrick et al.
2005/0106546 A1 * 5/2005 Strom ..... 434/307 A
2005/0123886 A1 * 6/2005 Hua et al. ..... 434/307 A
2006/0228683 A1 10/2006 Jianping
2007/0065794 A1 * 3/2007 Mangum ..... 434/307 A
2007/0137463 A1 * 6/2007 Lumsden ..... 84/603
2007/0166683 A1 * 7/2007 Chang et al. ..... 434/307 R
2007/0287141 A1 * 12/2007 Milner ..... 434/307 A
2007/0292831 A1 * 12/2007 Lee ..... 434/307 A
2008/0026355 A1 * 1/2008 Petef ..... 434/307 A
2008/0113325 A1 * 5/2008 Mellqvist et al. ..... 434/307 A (Continued)

*Primary Examiner* — Jeffrey Donels
(74) *Attorney, Agent, or Firm* — Pillsbury Winthrop Shaw Pittman LLP

(57) ABSTRACT

A portable multimedia device stores multimedia content and sets of user preferences ("settings") for one or more users (karaoke participants), on a title by title basis, that the one or more users may wish to apply upon playback of the content. The content and settings are initially stored in the portable device with the use of a practice playback system. Once this is done, the portable device may be transported and connected to any performance playback system. The portable device and the performance system may be operated to select and play back any title of content stored in the device, applying the corresponding stored set of user preferences for the user.

36 Claims, 2 Drawing Sheets

U.S. PATENT DOCUMENTS

2008/0282871 A1* 11/2008 Chen ..... 84/610
2009/0132242 A1* 5/2009 Wang et al. ..... 704/216
2010/0017381 A1* 1/2010 Watson et al. ..... 707/4

* cited by examiner

PORTABLE MULTIMEDIA OR ENTERTAINMENT STORAGE AND PLAYBACK DEVICE WHICH STORES AND PLAYS BACK CONTENT WITH CONTENT-SPECIFIC USER PREFERENCES

TECHNICAL FIELD

Embodiments of the present invention relate to portable multimedia devices and systems and, in particular, to a portable device to store and play back karaoke content with associated content-specific user playback settings/preferences.

BACKGROUND

Karaoke systems are typically used in social gatherings where people who like to sing their favorite songs are accompanied by music while the lyrics of the song are displayed and the voice of the participant is mixed with the music. As such gatherings take place at different locations, the availability of songs, the hardware that the songs are played on, and the settings used (e.g., volume, tempo, pitch) may vary from location to location. As a result, a karaoke participant may not find a song planned to be sung or may encounter system settings that are different from the settings that the participant wants. Under such conditions, the participant's performance may suffer or the participant may be prevented from performing.

A current approach to this problem requires that karaoke participants bring their own songs to the performance location in a format that can be used by the resident karaoke system. At the time of performance, the participant adjusts the system settings, such as microphone sensitivity, music volume, pitch, tempo and text displays, to fit the specific needs of the participant. These adjustments may be time consuming.

In another approach to this problem, a karaoke music file is modified before a performance, for example on a practice system, to reflect a user's performance preferences and stored on a portable medium. A disadvantage of this approach is that the music file itself is modified with one set of preferences, and as a result, it cannot be used by another performer who has a different set of preferences and needs.

BRIEF DESCRIPTION OF THE DRAWINGS

Embodiments of the present invention are illustrated by way of example and not by limitation in the figures of the accompanying drawings in which.

DETAILED DESCRIPTION

Figure 1B:
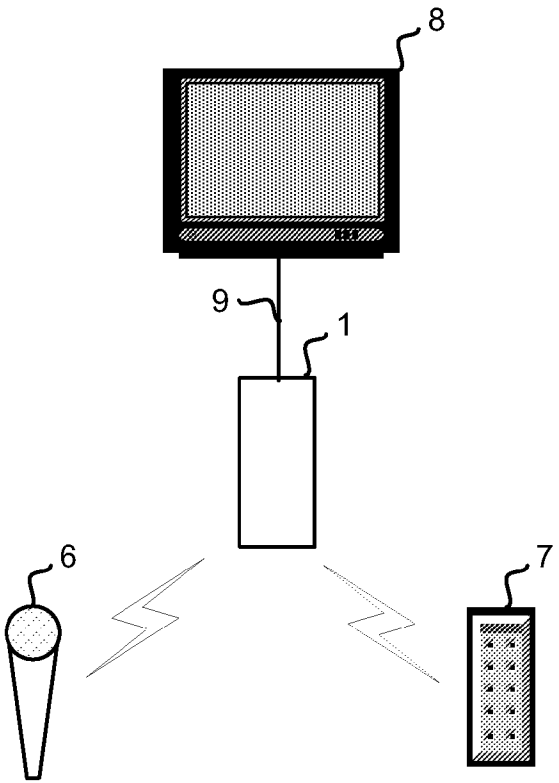
FIGS. 1A and 1B schematically illustrate the use of a portable multimedia device in a practice system and in a performance system, respectively, according to an embodiment of the invention.

A portable multimedia or entertainment storage and playback device is described herein. Note that references in this specification to "an embodiment", "one embodiment", or the like, mean that the particular feature, structure or characteristic being described is included in at least one embodiment of the present invention. Occurrences of such phrases in this specification do not necessarily all refer to the same embodiment.

The terms "settings" and "preferences" are used herein interchangeably.

The term "song", as used herein, broadly refers to any musical or musically based work of authorship, which can include audio as well as video, text (e.g., lyrics), graphics or any other types of data that may accompany such a work.

The term "title", as used herein, means any identified or identifiable individual work of authorship, such as a song or a music video.

As described in detail below, the solution introduced here includes a portable karaoke device that stores the data specific to a song (e.g., the music and lyrics) and also sets of user preferences ("settings") for one or more users (karaoke participants), on a song by song basis, that the one or more users may wish to apply upon performance of the songs. In certain embodiments, the device is sized generally so that it can be easily held in the palm of an average person's hand, although other form factors can instead be employed. The desired songs and settings are initially stored in the portable device with the use of a practice playback system, which may be a computer, and which includes a video display subsystem and a sound subsystem. However, other playback devices that have been made aware of the portable device and its functionality could serve as the practice playback system, such as a home use karaoke player connected to a separate or built-in monitor and speaker system, or a portable karaoke system.

Once the desired songs and settings are initially stored in the portable device, the portable device may be transported and connected to any karaoke performance system, which also includes a video display subsystem and a sound subsystem. The portable device and the performance system may be operated to select and play back any karaoke song stored in the device, applying the corresponding stored set of user preferences for the user.

Also introduced herein is a way to employ such a portable device to allow the convenient acquisition by a user of karaoke songs, on a song by song basis, just prior to karaoke song performance.

The portable device described herein has the capability to connect to a display, such as a television (TV) receiver, directly or through a peripheral device, such a DVD player, using standard communication interfaces. The device can receive the karaoke data to be stored from, for example, a computer, a built-in 802.11 Wi-Fi interface, or any other device that can interface with the portable device. For example, songs can be downloaded to the proposed device from a karaoke song server, which may be done via a wired connection, a wireless connection, or both. The portable device can be operated remotely using a remote control and a display to which the device is connected. This configuration provides song and setting selection information to the user and allows for receiving user input regarding these data. The portable device in combination with the performance system may be operated with the remote control to select karaoke songs and one or more sets of user preferences.

If a karaoke song is being downloaded from a commercial karaoke server, which requires payment for song use, billing information can also be presented to the user on the connected display. Additionally, the portable device or the remote control may be interfaced with (or integrated with) a microphone, via a wired or wireless connection, to provide a complete karaoke solution, both for purposes of identifying and storing the desired songs and settings (practice) as well as performance.

The concepts introduced here can be extended to apply to essentially any type of system or data to allow individual user preferred settings to be stored with content (data) for each title separately, so that they are maintained when moving from one performance/playback system to another. For example, a video clip can be stored on the portable device along with the preferred volume, pitch, color, hue, and other settings associated with the video clip, configured so that when the portable device is used in its reproduction mode, there is no need to make adjustments to satisfy the setting preferences of one or more individuals, for each title.

The portable device can be configured to receive and store karaoke song files, including music and lyrics, and to store user playback preferences, on a song by song allocation, which may be stored separately from the karaoke song files. The user preferences may be used to automatically modify the playback parameters of a playback system, to match a selected set of user preferences, without modifying the karaoke song files stored in the portable device. A user can store preferences on a song by song basis (or more generally, on a title by title basis, for any type of content). In addition, multiple users can use the same portable device, where each user can store his own set of preferences for any given song in the portable device.

In one embodiment, each song is stored in non-volatile memory in the portable device, and each song is associated in that non-volatile memory with a pointer to the corresponding set of users preferences, which are also stored in non-volatile memory in the portable device. For each song, a separate pointer for this purpose can be created for each user's preferences. Upon playback, the appropriate pointer (song-specific and user-specific) is accessed to locate and retrieve the appropriate preferences and apply them to the output media stream.

Figure 1A:
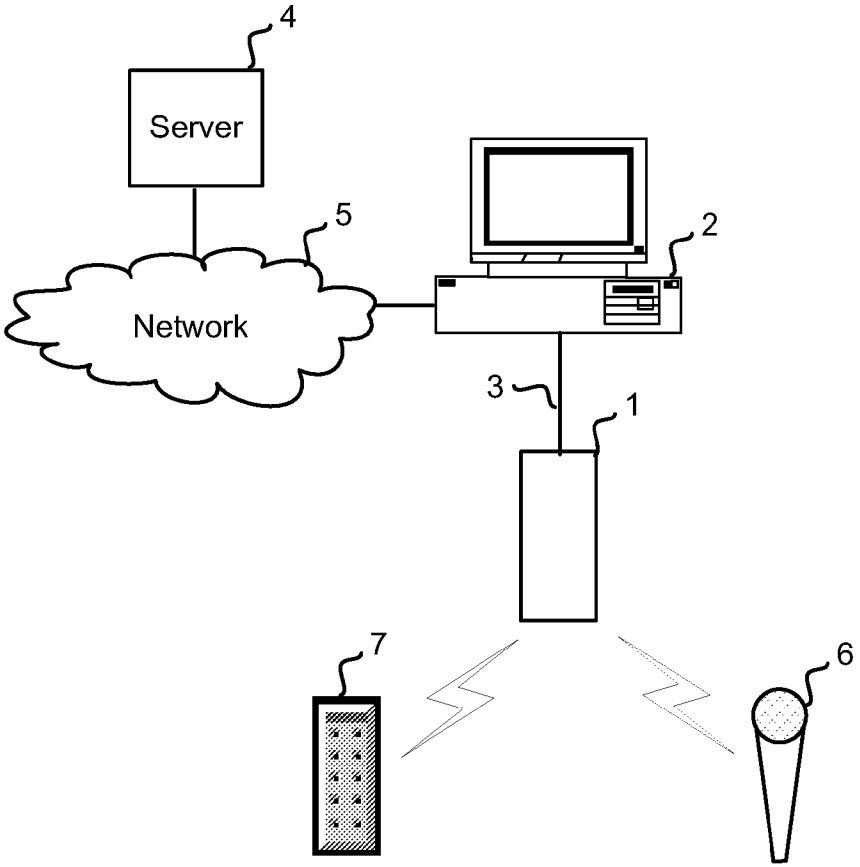

FIG. 1A shows a practice configuration in which the portable device can be used, while FIG. 1B shows a performance configuration in which the portable device can be used. The portable device 1 can be connected to a conventional personal computer 2 or a TV 8. The computer 2 may be connected to a remote karaoke song server 4 via a network 5, which may be or include the Internet, for example. Karaoke songs and preferred user settings can be downloaded into a non-volatile memory in the portable device 1, by using the computer. The computer 2 can also build the song's directory in the karaoke device's memory.

In one embodiment, the portable device 1 is configured to connect to the computer 2 via a conventional digital interface 3, such as a universal serial bus (USB), or Firewire (IEEE-1394) interface. Karaoke songs and preferred user settings can be downloaded into a non-volatile memory in the portable device 1, by using the computer 2. The computer 2 can also build the song's directory in the karaoke device's memory. The software which enables and/or controls these operations can be stored in the portable device 1, the computer 2, or both.

The user can practice the song and adjust various settings of the song in a manner compatible with the voice and preferences of the user. For example, the user may desire to reduce the music volume, adjust the equalizer for either the music or the participant's voice, change the music tempo, key, and pitch, or add special effects such as echo and chorus, either globally for the entire song, or for specified portions of the song. In a particular embodiment, selection of the instruments that accompany the karaoke participant's performance may also be enabled. For example, only a guitar track, or another instrument, instead of all the instruments in parallel, could be employed throughout the performance, or designated to be active at certain times.

The settings can be tested and modified by the user who practices songs by using a microphone 6, which is either in communication with or integral with the portable device. In one embodiment, the microphone 6 can be built into the remote control 7, such that the participant can provide the voice portion by singing into the remote control 7.

Any or all of these operations (identifying, selecting, downloading and performing songs, selecting settings, etc.) may be controlled by using the remote control 7 in conjunction with menus and other user interface features generated by the portable device 1 or the computer 2 and displayed on the computer 2. In some embodiments, the computer 2 may be used to directly control at least some of these operations. In one embodiment, the remote control 7 is integral with, but detachable from, the portable device 1.

The above-described operations can be repeated by the user to store multiple songs, each with its own specific set of preferences, in the portable device 1. Furthermore, by multiple users employing essentially this same process, any given song stored in the portable device 1 may be associated with a separate set of preferences for each of the multiple users.

FIG. 1B shows a performance configuration in which the portable device can be used. When the participant is ready to perform a selected song on a separate performance system 8, the portable device 1 is connected to the performance system 8, which may be a TV, another computer or a dedicated karaoke playback system, for example. The portable device 1 is configured to connect to the performance system 8 via a conventional audio-video interface 9, which may be, for example, an analog composite interface, a component video interface, an HDMI digital interface or a USB digital interface.

Any song stored in the portable device 1 can be played back on the performance system using the corresponding song-specific, user-specific settings preferences previously selected and stored in the portable device 1 by the user. Using, for example, the performance TV as a display for the portable device 1, the remote control 7 can be operated by the user to carry out menu selection of the songs stored in the portable device 1, or for other desired settings, including the adjustment of the preferred settings. Hence, playback will be as was planned by the user in the practice configuration.

The portable device 1 can be used to store essentially any content and respective settings, allowing the user to efficiently move content from one system to another without any need to adjust settings. For example, a video clip downloaded to the portable device 1 may contain, in addition to the audio-video content, specific settings such as volume, color adjustments, audio equalization, and more. Therefore, using for example a video/audio interface (e.g., USB interface) incorporated into a DVD player, the portable device 1 can be plugged into a DVD player so equipped, and the clip can be reproduced as preferred by the user of the portable device 1.

In certain embodiments, the portable device 1 tracks the user's voice range and automatically adapts the music reproduction to that voice range, e.g., in tempo, pitch, etc., which can be done by employing standard, well-known karaoke algorithms. In comparison to prior solutions, no content change occurs to the music, thereby permitting adapted voice and music parameters to be easily optimized by the user, or completely reversed, allowing a second user to immediately use the same karaoke file. This is possible because the original content is kept unchanged.

Figure 2:
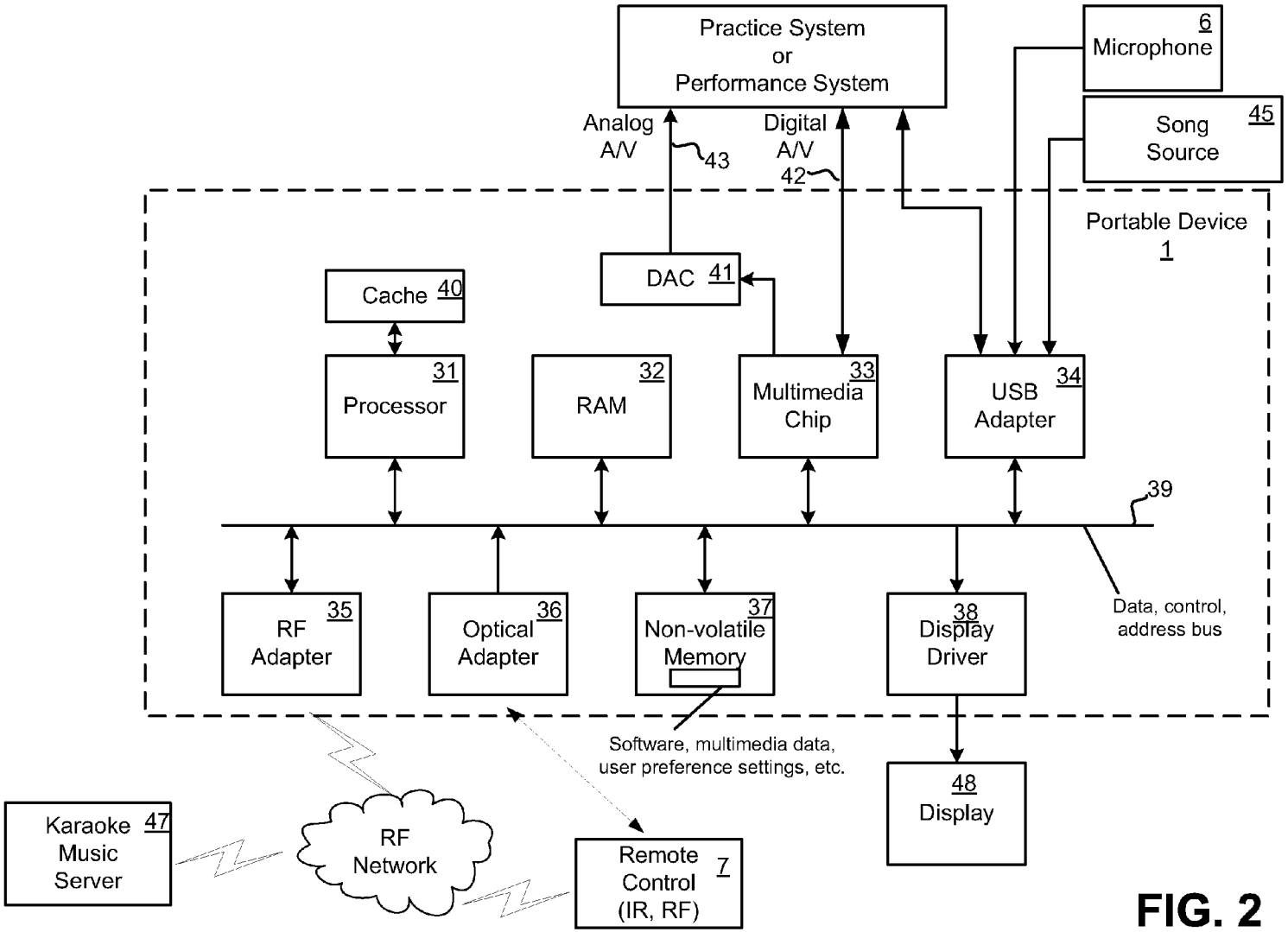
FIG. 2 is a block diagram illustrating components of a portable multimedia device according to an embodiment of the invention.

FIG. 2 is a block diagram illustrating components of the portable device 1 according to an embodiment of the invention. In the illustrated embodiment, the portable device 1 includes a processor 31, random access memory (RAM) 32, a multimedia chip 33, a USB adapter 34, a radiofrequency (RF) communication adapter 35, an optical communication adapter 36, non-volatile memory 37, and a display driver 38.

These components are all coupled to each other by a bus system 39, which enables communication of data, control signals and address information between components. The portable device 1, as illustrated in FIG. 2, also includes a cache memory 40 coupled to the processor 31 and a digital-to-analog converter (DAC) 41 coupled to the multimedia chip 33.

The processor 31 is the central processing unit (CPU) of the portable device and, as such, controls the overall operation of the portable device, including how it interacts with the practice system and the playback system. The processor may be or include, for example, one or more general-purpose programmable microprocessors, application-specific integrated circuits (ASICs), programmable logic devices (PLDs), field-programmable gate arrays (FPGAs), etc.

The cache memory 40 is used for short-term storage of program code and/or data, to improve overall performance of the processor 31. The RAM 32 functions as the main (system) memory of the portable device 1 and is used to temporarily store program code executed by the processor, and data.

The non-volatile memory 37 is used to store various karaoke song data (and/or other types of content) and corresponding user preference settings. The non-volatile memory 37 may also store software (or more precisely, firmware) that the processor 31 and/or multimedia chip 33 execute to control operations of the portable device 1. In some embodiments, the user settings may be stored in a separate physical memory from the corresponding song data. Therefore, the non-volatile memory 37 can be implemented in the form of one physical memory device or multiple physical memory devices. The non-volatile memory 37 may be, for example, flash memory, a form of electrically programmable read-only memory (EEPROM), solid-state disk (SSD), or any other form of non-volatile memory that can be incorporated into a highly portable (e.g., hand-held) device.

The multimedia chip 33 combines data of different modalities into a single output media stream, for output to the practice system or the performance system (depending on the mode of use). For example, the multimedia chip 33 combines audio data (e.g., music and voice), video data, text representing lyrics, etc., and also applies a currently selected set of user settings to the output data while doing so. The multimedia chip 33 may be, for example, an appropriately programmed digital signal processor (DSP). The multimedia chip 33 may couple directly to the practice system or performance system via a conventional digital audio/video interface 42 on the practice or performance system, or through the DAC 41 to a conventional analog audio/video interface 43 on the performance system.

The USB adapter 34, which may be a multi-port adapter, is used to connect the portable device 1 to a USB digital microphone 6, a song source 45 (e.g., a computer or a network adapter) and a performance system (e.g., a TV). Note that while a USB interface is described herein as an example of an interface to connect the portable device 1 to various input, display and playback systems and peripheral devices, it should be understood that other types of interfaces could instead be used. For example, the use of a wireless interface such as Wi-Fi or infrared (IR), or another type of wired interface such as IEEE 1394 ("Firewire"), could serve as alternatives to USB for these purposes. Further, the portable device 1 can also include a separate analog input port (not shown) connected to an analog-to-digital converter (not shown) to allow a conventional analog microphone to be employed.

The RF communication adapter 35 and the optical communication adapter 36 each may be used to communicate with the remote control 7, the microphone 6, and/or a remote karaoke music server 47, depending on the desired implementation. The RF adapter 35 may be, for example, a Wi-Fi adapter. The optical adapter 36 may be, for example, an infrared (IR) adapter. Note that these various types of adapters (USB, RF, optical) are provided here only as examples and, thus, may not all necessarily be present in any given embodiment. Further, different types of adapters not mentioned here may alternatively be used for these purposes and other embodiments.

The display driver 38 drives an external display device 48, such as a TV or a dedicated monitor, for purposes of identifying and selecting songs and user settings, as well as for performance purposes. Note that in some embodiments, however, the portable device 1 may have its own integrated display device, such as a liquid crystal display (LCD) display.

The bus system 39 shown in FIG. 2 is an abstraction that represents any one or more separate physical buses and/or point-to-point connections, connected by appropriate bridges, adapters and/or controllers. The bus system 39, therefore, may include, for example, a system bus, a form of Peripheral Component Interconnect (PCI) bus, HyperTransport or industry standard architecture (ISA) bus, small computer system interface (SCSI) bus, universal serial bus (USB), or Institute of Electrical and Electronics Engineers (IEEE) standard 1394 bus (sometimes referred to as "Firewire").

The techniques introduced above can be implemented at least partially in special-purpose hardwired circuitry, in software and/or firmware in conjunction with programmable circuitry, or in a combination thereof. Special-purpose hardwired circuitry may be in the form of, for example, one or more application-specific integrated circuits (ASICs), programmable logic devices (PLDs), field-programmable gate arrays (FPGAs), etc.

Software or firmware to implement the techniques introduced here may be stored on a machine-readable medium and may be executed by one or more general-purpose or special-purpose programmable microprocessors. A "machine-readable medium", as the term is used herein, includes any mechanism that provides (i.e., stores and/or transmits) information in a form accessible by a machine (e.g., a computer, network device, personal digital assistant (PDA), manufacturing tool, any device with a set of one or more processors, etc.). For example, a machine-accessible medium includes recordable/non-recordable media (e.g., read-only memory (ROM); random access memory (RAM); magnetic disk storage media; optical storage media; flash memory devices; etc.), etc.

The term "logic", as used herein, can include, for example, special-purpose hardwired circuitry, software and/or firmware in conjunction with programmable circuitry, or a combination thereof.

Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

What is claimed is:

1. A method comprising:

providing a user interface, by a portable device, for display on an external device to select multimedia content;

receiving multimedia content at the portable device;

storing in the portable device the multimedia content and user preferences for playback of the multimedia content, wherein the user preferences are specific to the multimedia content;

causing playback of the multimedia content stored in the portable device according to the user preferences stored in the portable device, without modifying the multimedia content stored in the portable device; and tracking a voice range of a user and automatically adapting one or more playback parameters of the multimedia content based on the voice range of the user, wherein user preferences based on the voice range and playback parameters are stored by the portable device.

2. A method as recited in claim 1, wherein the multimedia content comprises entertainment content.

3. A method as recited in claim 1, wherein the multimedia content comprises a particular title of karaoke content.

4. A method as recited in claim 1, further comprising:

repeating said receiving, said storing, and said causing playback, for each of a plurality of titles of multimedia content, to cause a separate set of user playback preferences to be stored in association with each said title of multimedia content in the portable device.

5. A method as recited in claim 1, wherein said user preferences correspond to a first user, the method further comprising:

receiving and storing in the portable device a separate set of user preferences for playback of the multimedia content, the separate set of user preferences corresponding to a second user.

6. A method as recited in claim 1, wherein said user preferences correspond to a first user, the method further comprising:

receiving and storing in the portable device a separate set of user preferences for playback of the multimedia content, the separate set of user preferences corresponding to a second playback variation of the multimedia content for the first user.

7. A method as recited in claim 1, further comprising:

receiving a user voice during playback of said multimedia content on the external performance system; and combining the user voice with said multimedia content in the portable device, during playback on the external performance system.

8. A method as recited in claim 1, further comprising:

receiving user input at the portable device from a remote control via a wireless communication link.

9. A method as recited in claim 1, wherein receiving the multimedia content at the portable device comprises receiving the multimedia content from a remote computer via a network.

10. A method as recited in claim 9, further comprising:

causing information to be output to a user to enable the user to locate and initiate download of the multimedia content from the remote computer;

receiving first user input requesting download of the multimedia content; and causing the multimedia content to be downloaded from the remote computer in response to the first user input.

11. A method as recited in claim 10, further comprising:

causing information to be output to a user to enable the user to pay for acquisition or use of the multimedia content; and receiving second user input representing confirmation of payment for acquisition or use of the multimedia content.

12. A method as recited in claim 1, wherein:

user preferences for playback of multimedia content include user selections of one or more instrumental tracks in the multimedia content.

13. A method comprising:

providing a user interface, by a portable device, for display on an external device to select multimedia content;

receiving first user input specifying adjustment to and selection of a set of user playback preferences for a particular title of multimedia content, in conjunction with playing back said particular title of multimedia content on a practice playback system;

receiving said particular title of multimedia content at the portable device;

storing said particular title of multimedia content and the selected set of user playback preferences in association with each other in the portable device, wherein the selected set of user playback preferences are specific to said particular title of multimedia content;

receiving second user input at the portable device, the second user input for initiating playback of said particular title of multimedia content stored in the portable device;

causing playback of said particular title of multimedia content stored in the portable device, in response to the second user input, on an external performance system based on the set of user playback preferences stored in the portable device; and tracking a voice range of a user and automatically adapting one or more user playback preferences based on the voice range of the user, wherein user preferences based on the voice range and playback parameters are stored by the portable device.

14. A method as recited in claim 13, wherein causing playback of said particular title of multimedia content stored in the portable device comprises:

causing said particular title of multimedia content stored in the portable device to be played back without modifying the multimedia content stored in the portable device.

15. A method as recited in claim 13, wherein said particular title of multimedia content comprises music and text associated with lyrics of a particular song.

16. A method as recited in claim 13, further comprising:

receiving a user voice during playback of said multimedia content on the external performance system; and combining the user voice with said multimedia content in the portable device, during playback on the external performance system.

17. A method as recited in claim 16, further comprising:

receiving a user voice during playback of said multimedia content on the practice playback system; and combining the user voice with said multimedia content in the portable device, during playback on the practice playback system.

18. A method as recited in claim 13, wherein receiving second user input at the portable device comprises:

receiving the second user input from a remote control via a wireless communication link.

19. A method as recited in claim 13, wherein receiving said particular title of multimedia content at the portable device comprises receiving said particular title of multimedia content from a remote computer via a network.

20. A method as recited in claim 13, further comprising:

storing in the portable device a separate set of user playback preferences in association with each of a plurality of titles of multimedia content stored in the portable device.

21. A method as recited in claim 13, further comprising:

storing in the portable device a separate set of user playback preferences for each of a plurality of users, for said particular title of multimedia content.

22. A method as recited in claim 21, further comprising:

causing information to be output to a user to enable the user to locate and initiate download of said particular title of multimedia content from the remote computer;

receiving first user input requesting download of said particular title of multimedia content; and causing said particular title of multimedia content to be downloaded from the remote computer in response to the first user input.

23. A method as recited in claim 22, further comprising:

causing information to be output to the user to enable the user to pay for acquisition or use of said particular title of multimedia content; and receiving second user input representing confirmation of payment for acquisition or use of said particular title of multimedia content.

24. A portable multimedia device comprising:

a first communication interface to receive multimedia content from an external source;

a non-volatile storage facility to store the multimedia content and user preferences for playback which are specific to the multimedia content;

a processing unit, coupled to the communication interface and the non-volatile storage facility, to cause playback of the stored multimedia content according to the stored user preferences, without modifying the stored multimedia content, to provide a user interface for display on an external device to select multimedia content, to track a voice range of a user and automatically adapt one or more user preferences based on the voice range of the user, wherein user preferences based on the voice range and playback parameters are stored by the portable multimedia device;

a second communication interface to output the multimedia content, modified by the user preferences, to an external performance system during playback of the multimedia content; and a housing containing the communication interface, the non-volatile storage facility, the processor and the second communication interface.

25. A portable multimedia device as recited in claim 24, wherein the portable multimedia device is sized generally so as to be able to be held in one hand.

26. A portable multimedia device as recited in claim 24, further comprising a remote control to enable a user to control operation of the portable multimedia device, including selection and storage of the user preferences in the portable multimedia device, via a wireless communication link.

27. A portable multimedia device as recited in claim 26, wherein the remote control is integral with, but detachable from, the portable multimedia device.

28. A portable multimedia device as recited in claim 27, wherein the remote control comprises a microphone.

29. A portable multimedia device as recited in claim 24, wherein the multimedia content comprises music and text of associated lyrics.

30. A portable multimedia device as recited in claim 28, further comprising:

a microphone to receive a user voice during playback of said music, wherein the portable multimedia device is operable to combine the user voice with said music for playback on the external performance system.

31. A portable multimedia device as recited in claim 30, wherein the microphone is integral with the portable multimedia device.

32. A portable multimedia device as recited in claim 24, wherein the multimedia content comprises music and text of associated lyrics.

33. A portable multimedia device as recited in claim 24, wherein the portable multimedia device is operable by a user to:

enable the user to adjust and select a set of user playback preferences for a particular title of multimedia content, in conjunction with playing back said particular title of multimedia content on a practice playback system;

store the selected set of user playback preferences and said particular title in the portable multimedia device in association with each other; and cause said particular title of multimedia content to be played back on the external performance system according to the stored set of user playback preferences.

34. A portable multimedia device as recited in claim 24, further comprising:

a display interface through which to couple the portable multimedia device to an external display device;

wherein the processor is configured to generate on the display device a graphical user interface for controlling functions of the portable multimedia device.

35. A portable multimedia device as recited in claim 24, wherein the processor is configured to cause the portable multimedia device to cause payment information relating to acquisition or use of said particular title of multimedia content to be output to a user.

36. A portable karaoke device comprising:

a first communication interface to receive, from a source, song data representing music and text of associated lyrics for a song;

a non-volatile memory to store the song data and user preferences which are specific to said song, for playback of the song;

a processing unit, coupled to the communication interface and the non-volatile storage facility, to cause playback of the song on an external audio-video performance system according to the user preferences, without modifying the stored song data, to receive a tracked voice range of a user and automatically adapt one or more of the user preferences based on the voice range of the user, wherein user preferences based on the voice range and playback parameters are stored by the portable karaoke device, and to provide a user interface for display on an external device to select multimedia content;

a second communication interface to output the song data, modified by the user preferences, to the external audio-video performance system during playback of the song; and a housing containing the communication interface, the non-volatile memory, the processor and the second communication interface, sized generally so that the portable multimedia device can be held in one hand.

* * * * *